US008346507B2

(12) United States Patent
Shahi et al.

(10) Patent No.: US 8,346,507 B2
(45) Date of Patent: Jan. 1, 2013

(54) SYSTEM AND METHOD FOR DETECTING FLUID DELIVERY SYSTEM CONDITIONS BASED ON MOTOR PARAMETERS

(75) Inventors: Prakash B. Shahi, St. Louis, MO (US); Eric J. Wildi, St. Louis, MO (US); Mark E. Carrier, Wildwood, MO (US); Randy L. Bomkamp, Creve Coeur, MO (US); Hung M. Pham, Dayton, OH (US); William P. Butler, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 13/079,320

(22) Filed: Apr. 4, 2011

(65) Prior Publication Data

US 2011/0178773 A1 Jul. 21, 2011

Related U.S. Application Data

(63) Continuation of application No. 12/368,577, filed on Feb. 10, 2009, now Pat. No. 7,941,294.

(51) Int. Cl.
*G06F 11/30* (2006.01)
*G21C 17/00* (2006.01)

(52) U.S. Cl. ..... 702/182

(58) Field of Classification Search ..... 702/182
See application file for complete search history.

(56) References Cited

U.S. PATENT DOCUMENTS 4,581,900 A * 4/1986 Lowe et al. ..... 62/228.1
5,447,414 A 9/1995 Nordby et al.
5,793,623 A 8/1998 Kawashima et al.
5,810,908 A 9/1998 Gray et al.
6,452,487 B1 * 9/2002 Krupinski ..... 340/440
6,993,414 B2 1/2006 Shah
6,994,620 B2 2/2006 Mills
7,261,762 B2 8/2007 Kang et al.
7,342,379 B2 3/2008 Marcinkiewicz et al.
8,020,727 B2 * 9/2011 Herman et al. ..... 222/1
2003/0052791 A1 3/2003 Reinhardt et al.
2003/0070544 A1 4/2003 Mulvaney et al.
2004/0113803 A1 6/2004 Keown
2005/0247194 A1 11/2005 Kang et al.
2006/0055547 A1 3/2006 DiMaggio
2006/0058924 A1 3/2006 Shah
2006/0185373 A1 * 8/2006 Butler et al. ..... 62/181
2007/0209377 A1 9/2007 Beifus et al.
2007/0234746 A1 10/2007 Puranen et al.
2007/0248467 A1 10/2007 Shahi et al.
2010/0070234 A1 * 3/2010 Steinberg et al. ..... 702/130
2010/0076605 A1 3/2010 Harrod et al.

* cited by examiner

*Primary Examiner* — Cindy H Khuu
(74) *Attorney, Agent, or Firm* — Thompson Coburn LLP

(57) ABSTRACT

Systems and methods for detecting various system conditions in a fluid delivery system (such as an HVAC system) based on a motor parameter are disclosed. Embodiments of the present invention relate to detecting: filter condition, frozen coil condition, register condition, energy efficiency, system failure, or any combination thereof. Embodiments of the present invention relate to detecting fluid delivery system conditions based on motor parameters including system current, system power, system efficiency, motor current, motor power, motor efficiency, and/or a change (or rate of change) in motor parameters. Techniques for responding to a clogged filter and a frozen coil are also disclosed. Also disclosed are techniques for characterizing a fluid delivery system off-site, prior to system installation.

14 Claims, 7 Drawing Sheets

SYSTEM AND METHOD FOR DETECTING FLUID DELIVERY SYSTEM CONDITIONS BASED ON MOTOR PARAMETERS

CROSS-REFERENCE TO RELATED APPLICATION

The present application is a continuation application of U.S. patent application Ser. No. 12/368,577, filed Feb. 10, 2009, the entire contents of which is incorporated herein by reference.

FIELD OF THE INVENTION

This invention relates to a method and system for detecting system conditions in a fluid delivery system. For example, the present invention was developed for use with heating, ventilation and/or cooling ("HVAC") systems. Techniques within the scope of the present invention allow for detection of various system conditions based on motor parameters associated with a motor in the fluid delivery system. Exemplary embodiments of the present invention relate to detecting: filter condition, frozen coil, register condition, energy efficiency, and system failure.

DESCRIPTION OF THE RELATED ART

The related art includes U.S. Pat. No. 6,993,414 to Shah entitled "Detection of clogged filter in an HVAC system". Shah discloses that static pressures are measured in an HVAC system and utilized to predict the condition of a filter in the HVAC system. Shah discloses that pressure measurements in an HVAC system are utilized to determine when an air filter has been clogged to the point that it should be replaced.

The related art further includes U.S. Patent Pub. 2006/0058924 to Shah entitled "Detection of clogged filter in an HVAC system". Shah discloses that static pressure can be calculated as a function of the delivered air flow, and the sensed fan motor speed, taken with constants characterizing the particular furnace and fan model. Shah recognizes that changes in static pressure are indicative of the changing condition of the filter.

The related art further includes U.S. Pat. No. 6,994,620 to Mills entitled "Method of determining static pressure in a ducted air delivery system using a variable speed blower motor". Mills discloses that static air pressure is mathematically determined as a function of system parameters, such as blower speed, blower diameter, system volume airflow rate, and/or blower motor torque.

The related art further includes U.S. Patent Pub. 2007/0234746 to Puranen et al. entitled "Methods for detecting and responding to freezing coils in HVAC systems". Puranen discloses that static pressure can be calculated as a function of the delivered air flow, and the sensed fan motor speed. Puranen also provides for detecting and responding to a coil condition in the HVAC system, and correlating an increase in airflow restriction in the system with a potentially frozen coil.

SUMMARY OF THE INVENTION

The inventors herein have developed a novel system and method for detecting system conditions based at least in part on a motor parameter associated with at least one motor in the system. Exemplary embodiments of the present invention relate to detecting: filter condition, frozen coil, register condition, energy efficiency, system failure, or any combination thereof. The techniques disclosed herein are capable not only of detecting a system condition, but also distinguishing between various system conditions.

The phrase "and/or" as used herein means "either or both".

The phrase "motor parameter" is used herein to refer to at least one of: motor current, motor power, motor efficiency, system current, system power, and system efficiency.

Exemplary embodiments relate to detecting system conditions based at least in part on motor parameters, change in motor parameters, rate of change in motor parameters, or any combination thereof. In contrast to the related art cited above, the present invention does not rely on static pressure measurements or calculations of static pressure. Calculating motor parameters provides several advantages over calculating static pressure. For example: (1) the motor parameters relate directly to the electricity used in the system, (2) efficiency is easily understood, such as by homeowners who are not skilled in the field, and (3) efficiency also provides a measure of electricity waste in the system.

Exemplary embodiments relate to reducing or eliminating the need for on-site system characterization. For example, system characterization may be performed off-site for a particular system model (e.g. a particular model of furnace or air handler) and this characterization data may be used for all installations of that system model.

The phrase "system current" is used herein to refer to any measurement or estimate of electrical current associated with a system comprising an electric motor. In an exemplary embodiment, the "system current" comprises the electrical input current provided to (or drawn by) a system comprising an electric motor. Current can be measured in Amperes or "Amps", as well as other units as is well known. In an exemplary embodiment, system current is measured using an ammeter on the input power line to an HVAC system.

The phrase "motor current" is used herein to refer to any measurement or estimate of electrical current associated with an electric motor. In an exemplary embodiment, the "motor current" comprises the electrical input current provided to (or drawn by) an electric motor. One method for measuring motor current is to measure the potential across shunt resistors that are in series with the phase windings. It will be apparent to those of ordinary skill in the art that one, two or three shunts may be placed strategically in the control board to reconstruct the phase currents to the motor.

The phrase "system power" is used herein to refer to any measurement or estimate of power in a system comprising an electric motor. In an exemplary embodiment, the "system power" comprises the electrical input power provided to (or drawn by) a system comprising an electric motor. Power can be measured in units of Watts, as well as other units as is well known. In an exemplary embodiment, system power is measured using a power meter on the input power line to an HVAC system.

The phrase "motor power" is used herein to refer to any measurement or estimate of power associated with an electric motor. In an exemplary embodiment, the "motor power" comprises the electrical input power provided to (or drawn by) an electric motor. Motor power may be measured using a power meter, e.g. on the input power line to the motor. In an exemplary embodiment wherein the motor receives three phase power, motor power may be calculated as:

$$V_a \cdot I_a + V_b \cdot I_b + V_c \cdot I_c$$

i.e., the instantaneous sum of the product of the voltages and currents in each phase of the motor winding. Three-phase variables (in abc coordinate) may be transformed into two-phase time variant variables (in alpha-beta coordinate) using Clarke Transform. Further, two-phase time variant variables can be transformed into two-phase time invariant variables (in d-q co-ordinate) using Park Transform. It will be apparent to a person of ordinary skill in the art that rotor position may be measured using a sensor such as encoder or estimated using back EMF sensing or flux sensing, etc. One method for estimating rotor position is from the flux observer, as disclosed in U.S. Pat. No. 7,342,379, entitled "Sensorless control systems and methods for permanent magnet rotating machines", the entire disclosure of which is incorporated by reference herein. Then motor power for surface magnet motor may be measured by Power=3/2*Iq*Wr*Qf, where, Iq is the current component in q axis, Wr is the electrical speed of the motor and Qf is the back EMF constant of the motor. In an exemplary embodiment, the "motor power" comprises a motor's mechanical power or "shaft power". Mechanical shaft power may be calculated based on rotor position.

The phrase "system efficiency" is used herein to refer to any measure or estimate of efficiency in a system comprising an electric motor. One example of system efficiency is a relationship between airflow and system power. Airflow may refer to the airflow for a single fan/motor, or may refer to airflow for multiple fans/motors (e.g. total system airflow). Airflow may be measured in units of cubic feet per minute or "CFM", as well as other units, as is well known. One exemplary measure of system efficiency is the ratio of airflow to system power, which can be expressed in terms of CFM/Watt. Another exemplary measure of system efficiency is the ratio of system power to airflow, which can be expressed in terms of Watts/CFM (W/CFM). Another example of system efficiency is a relationship between airflow and system current. One exemplary measure of system efficiency is the ratio of airflow to system current, which can be expressed in terms of CFM/Amps. Another exemplary measure of system efficiency is the ratio of system current to airflow, which can be expressed in terms of Amps/CFM. Other measures of system efficiency may also be utilized without departing from the scope of the embodiments of the present invention.

The phrase "motor efficiency" is used herein to refer to any measure or estimate of efficiency associated with an electric motor. One example of motor efficiency is a relationship between airflow and motor power. One exemplary measure of motor efficiency is the ratio of airflow to motor power, which can be expressed in terms of CFM/Watt. Another exemplary measure of motor efficiency is the ratio of motor power to airflow, which can be expressed in terms of Watts/CFM (W/CFM). Another example of motor efficiency is a relationship between airflow and motor current. One exemplary measure of motor efficiency is the ratio of airflow to motor current, which can be expressed in terms of CFM/Amps. Another exemplary measure of motor efficiency is the ratio of motor current to airflow, which can be expressed in terms of Amps/CFM. Other measures of motor efficiency may also be utilized without departing from the scope of the embodiments of the present invention.

The phrase "filter condition" is used herein to refer to conditions related to a filter in a fluid delivery system. Detecting a filter condition may include detecting an unacceptably clogged filter, or determining a remaining filter life, as examples.

The phrase "frozen coil condition" is used herein to refer to conditions related to a cooling coil (e.g. condenser coil and/or evaporator coil) in a fluid delivery system. Detecting a frozen coil condition may include detecting an unacceptable level of ice and/or frost build-up on the coil, as an example.

The phrase "register condition" is used herein to refer to conditions related to a register, (e.g. vent opening), in a fluid delivery system. Detecting a register condition may include detecting a change in register position (e.g. opening/closing), or detecting a register blockage (e.g. a register blocked by furniture), as examples.

Many modern electric motors belong to the class known as "constant airflow motors." Constant airflow motors attempt to maintain airflow at a constant rate that is typically dictated by a motor controller. As airflow restriction increases, a constant airflow motor will respond by increasing motor speed and drawing more power. A constant airflow motor provides several advantages which facilitate the use of the techniques described herein. However, the techniques of the present invention are capable of use with other types of motors and are not limited to use with a constant airflow motor. Exemplary embodiments of the present invention could employ a constant power motor. In an embodiment wherein the motor is a constant power motor, the system could comprise an airflow sensor to thereby allow motor efficiency calculations.

DETAILED DESCRIPTION

Figure 1:
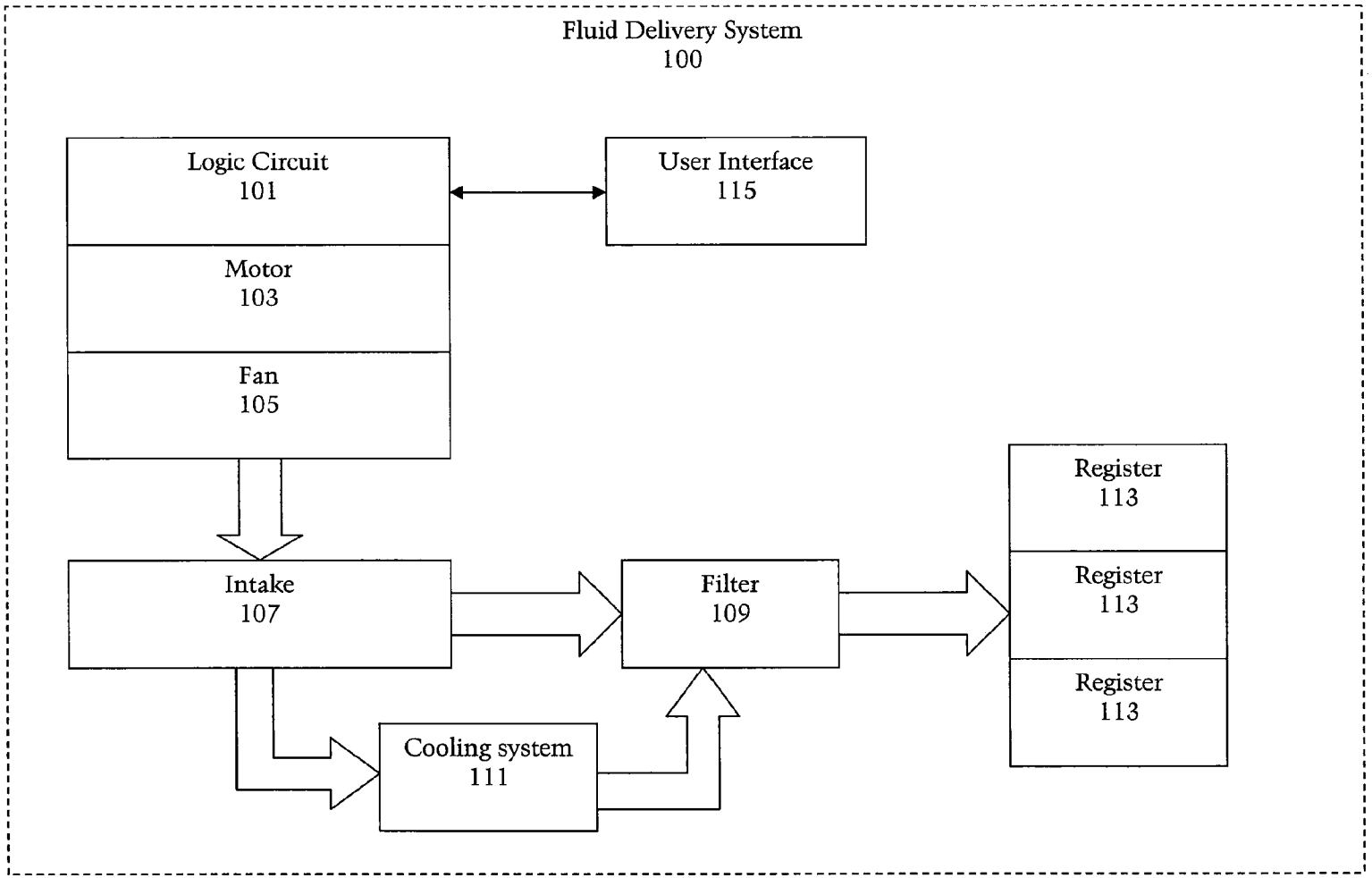
FIG. 1 illustrates an exemplary fluid delivery system.

FIG. 1 illustrates an exemplary fluid delivery system 100. Fluid delivery system 100 may be a heating, ventilation and air conditioning (HVAC) system. The fluid delivery system may or may not be installed in a building. Examples of a fluid delivery system include a furnace or air handler.

The system of FIG. 1 comprises logic circuit 101, electric motor 103, fan 105, intake 107, filter 109, cooling system 111, registers 113, and user interface 115.

Logic circuit 101 monitors and controls electric power provided to motor 103 and comprises any device capable of carrying out logic operations as is known in the art. Logic circuit 101 may be digital or analog, and exemplary embodiments include a micro-controller, a computer, a field-programmable gate array (FPGA), an application-specific integrated circuit (ASIC), or a programmable interrupt controller (PIC). Logic circuit 101 may comprise a stand-alone unit, or may be contained in a "motor control", a "master controller", a furnace controller, a thermostat, or other location in the system, as will be apparent to those of ordinary skill in the art.

Electric motor 103 provides mechanical power to fan 105. Electric motor 103 may be a constant airflow motor.

Fan 105 is operable to force a fluid through the system, thereby causing the fluid to follow a path from intake 107 to registers 113.

In an embodiment wherein the system is an HVAC system, the fluid is typically air. But the techniques of the present invention are not limited to use with air, and the fluid may comprise other gases or liquids and various mixtures thereof. For example, the fluid may be water and the motor 103 may be part of a water pump.

It should be noted that a fluid delivery system could comprise a plurality of motors and fans, and the techniques of the present invention could be utilized in conjunction with any or all of the motors in the system.

User interface 115 may be a thermostat or any electronic device that provides user input capability, as is known in the art. User interface 115 may comprise a display device for reporting information to the user.

User interface 115 is in communication with logic circuit 101. Communication between the user interface 115 and the logic circuit 101 may be achieved wirelessly, using conventional wireless schemes, such as Bluetooth or Wi-Fi as examples. This communication allows various reporting and control functions. For example, the logic circuit 101 can report detected system conditions to the user interface 115, and the user interface 115 can communicate instructions to the logic circuit 101. The user interface 115 may be operable to alert the user to detected system conditions in a variety of ways as is known in the art. For example, the user interface 115 could display an icon or text or sound an audible alarm in response to detection of a system condition. User interface 115 can communicate instructions, such as initialization instructions, to logic circuit 101.

The fluid delivery system may further comprise a "system memory" which can be any type of computer memory for storage of various information. Non-limiting examples of system memory include FLASH and RAM. The system memory may be part of the logic circuit 101 or part of the user interface 115, as examples.

The exemplary fluid path of FIG. 1 includes a filter 109 between the fluid intake 107 and registers 113. A typical filter becomes occluded ("clogged") gradually over time as it filters particles from a fluid. This occlusion typically impairs fluid flow through the filter, thereby increasing fluid flow restriction. A filter normally transitions from being clean to being unacceptably occluded in a gradual fashion, such that the time period between recommended filter cleaning/replacement is typically measured in months, although periods on the order of days (or hours or less) are certainly possible. It will be apparent that the phrase "unacceptably occluded" is a relative term and may vary from system to system.

In the exemplary embodiment depicted in FIG. 1, an optional fluid path includes cooling system 111, which extracts heat from the fluid. Cooling system 111 comprises a cooling coil.

Many types of cooling coils are susceptible to freezing. Freezing can occur due to freezing of condensation on the coil or freezing of a gas inside the coil. For example, in an HVAC system the air conditioner evaporator coils are susceptible to freezing. A frozen coil typically impairs fluid flow through the cooling system, thereby increasing fluid flow restriction. A coil typically transitions from being normal to frozen within a time period on the order of a few hours or less.

The cooling system may further comprise an electric motor. For example, an outdoor air conditioning unit could include a fan and motor for moving air over a condenser coil fluidly connected to the evaporator coil. In response to detecting a frozen coil condition of the evaporator coil, it may be helpful for the system to enter a "defrost mode" designed to thaw the frozen coil. Exemplary defrost modes are described in detail below with respect to FIG. 5.

Fluid delivery system 100 comprises a plurality of registers 113. Typically, registers 113 can be individually opened and closed (either manually or automatically) to thereby adjust fluid delivery. When an open register is closed, the result is typically a rapid increase in fluid flow restriction that occurs within a second or two.

It will be apparent to those of ordinary skill in the art that a wide variety of variations on FIG. 1 are within the scope of the invention. For example, the relationship of components shown in FIG. 1 is merely offered for exemplary purposes, and should not be construed as limiting. For example, the filter 109 could be located earlier in the path (e.g., before intake 107) or the filter 109 could be contained within the intake 107. It will also be apparent that the system is not limited to a single filter or a single cooling system. For example, a system 100 could include many filters, and the techniques of the present invention could be easily adapted for such a system. Many other variations will be apparent.

In an exemplary embodiment, electric motor 103 is a constant airflow motor. In such an embodiment, the system adjusts the power delivered to the motor 103 so as to maintain a constant airflow despite changes in the system (e.g. fluid flow restriction). For example, electric motor 103 may comprise a motor control which is programmed to adjust the power to motor 103 in order to maintain a constant airflow. As fluid flow restriction in the system increases (e.g. due to clogged filter, frozen coil, or register closing) a constant airflow motor will draw more electrical current and power in an attempt to maintain constant airflow. Therefore, a change in motor parameters may indicate a change in system conditions.

An increase in fluid flow restriction typically results in a corresponding decrease in motor efficiency and system efficiency. Therefore, a change in motor efficiency and/or system efficiency may indicate a change in system conditions.

Figure 2:
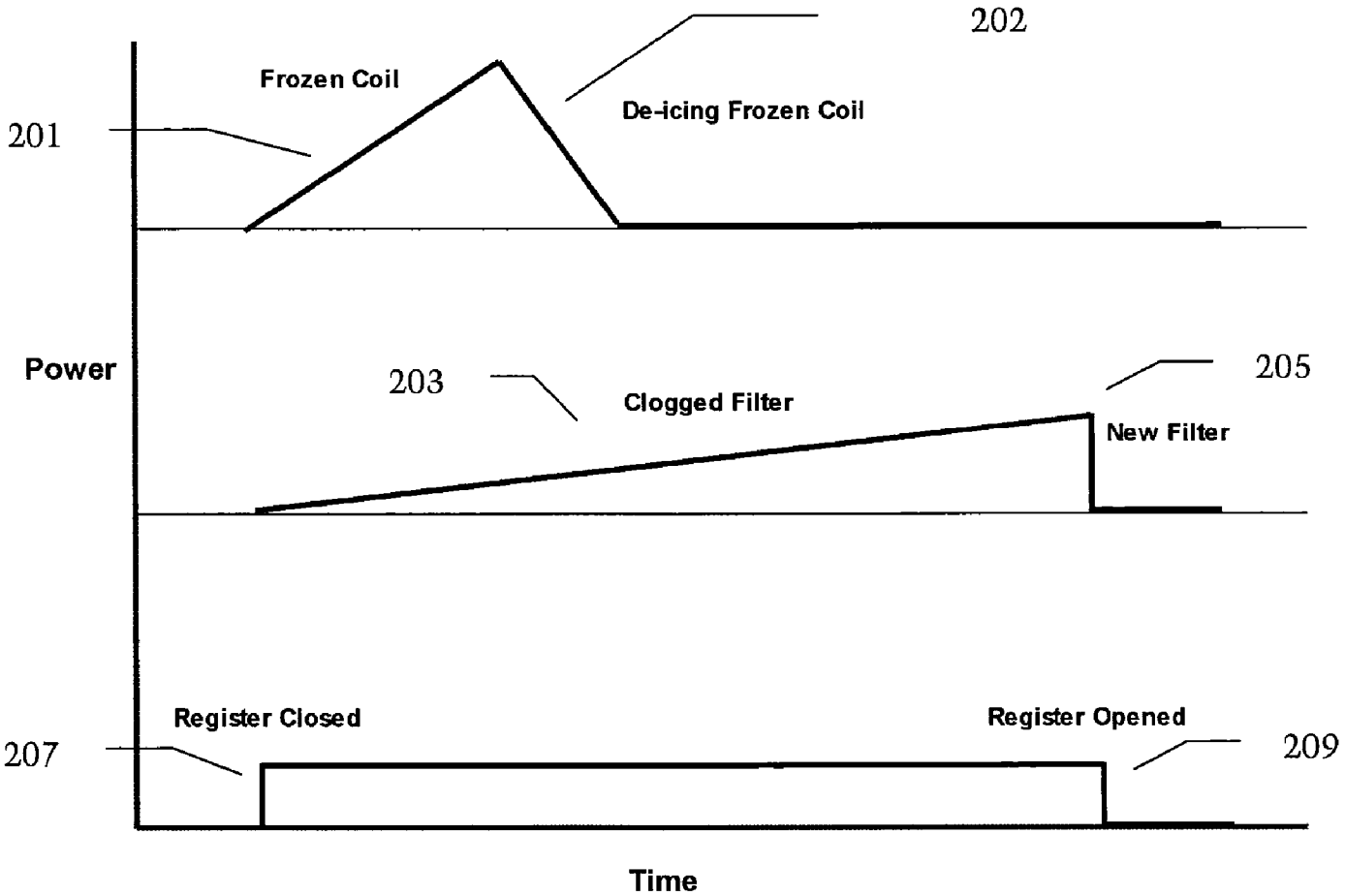
FIG. 2 illustrates a graphical depiction of the timescale of system conditions.

FIG. 2 depicts a graphical depiction of the timescale of change in motor power caused by frozen coil, clogged filter, and register opening/closing. As noted above, the time periods for the changes in system conditions described above (i.e. filter condition, coil condition, and register position) differ substantially.

As can be seen from FIG. 2, filter occlusion occurs gradually, resulting in a slow increase in motor power over time (or reduction in motor efficiency), typically over a period of months or more. As the filter traps particles from the fluid it becomes more occluded over time, and the motor requires more power to maintain a given airflow, as shown by the gradual slope of the power line 203. At 205 the filter is replaced, and motor power falls back to the baseline.

In contrast, a frozen coil typically occurs in a short period of time, typically a few hours or less, as shown by the steep slope of line 201 which represents a relatively rapid rise (relative to the clogged filter slope 203) in motor power (or reduction in motor efficiency). When the system enters a de-icing or de-frost mode, motor power drops back to nominal levels, as shown by line 202.

A register opening or closing results in an almost instantaneous change in motor power, as shown by the vertical slope of lines 207 and 209, respectively. A register opening or closing is typically reflected within a few seconds or less resulting in a rapid increase in motor power (or reduction in motor efficiency).

The inventors of the system described herein have designed systems and methods capable of detecting system conditions and differentiating between system conditions based on these different rates of change. It will be apparent to those of ordinary skill in the art that motor parameters other than motor power may also reflect these different rates of change.

Figure 3A:
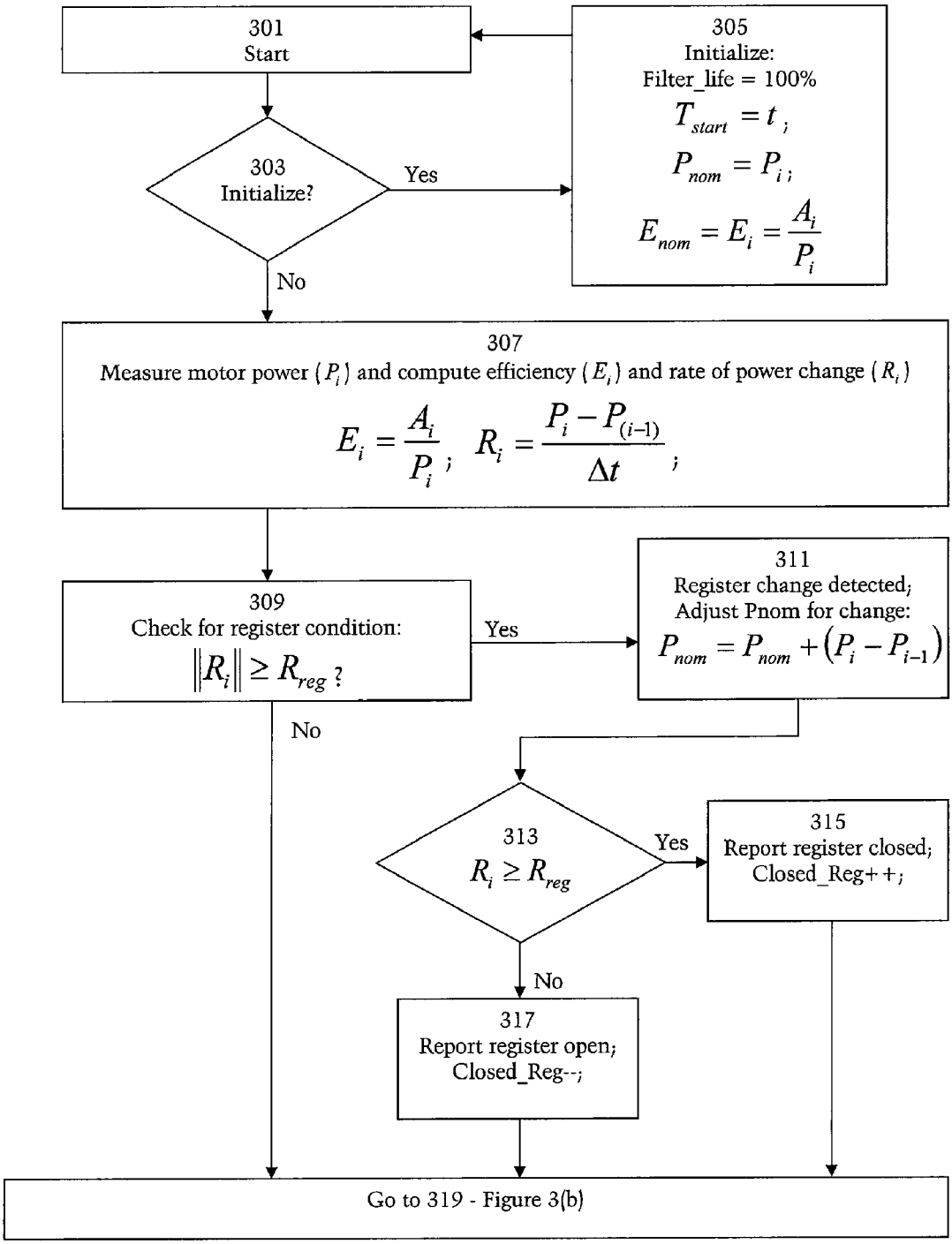
FIGS. 3(*a*)-3(*c*) illustrate an exemplary flow chart for detecting register condition, frozen coil condition, and filter condition.
Figure 3B:
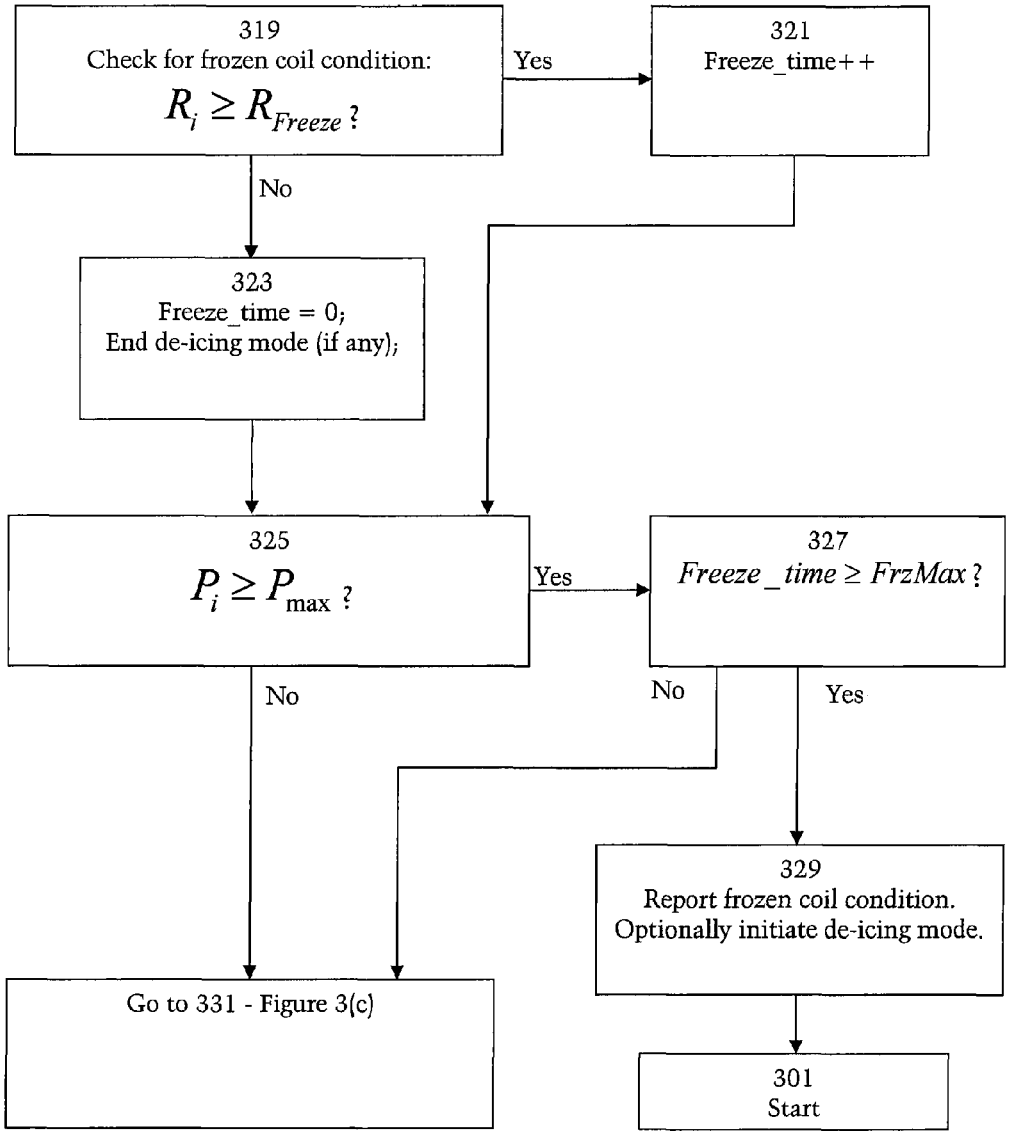
Figure 3C:
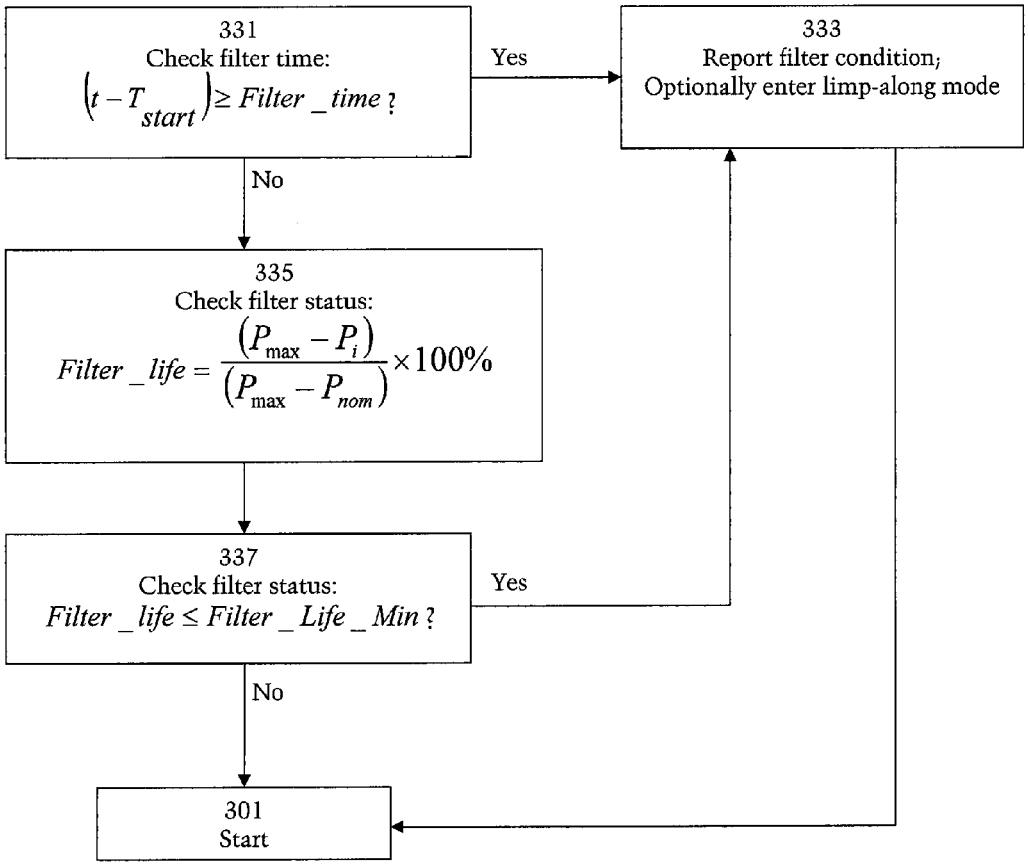

FIGS. 3(*a*)-3(*c*) illustrate an exemplary flow diagram for detecting and distinguishing register conditions (e.g. changes to register position), frozen coil condition, and filter condition. With reference to FIG. 3(*a*), step 301 marks the beginning of the flow diagram. The system may be configured to perform the steps of FIGS. 3(*a*)-3(*c*) at set intervals of time, e.g., every 2 seconds.

At step 303 the system checks whether an initialization command has been received. System initialization may be performed on-site and/or off-site (e.g. during characterization). For example, a furnace manufacturer may initialize the system off-site prior to installation in a building, and subsequent initializations may be performed on-site (e.g. by a homeowner when replacing a filter). System initialization may be performed by an operator. Initialization procedures may be automated (fully or partially).

In an exemplary embodiment, the initialization procedure comprises inserting a clean filter and opening all of the registers in the fluid delivery system. For example, the user of a system may perform the physical initialization procedure and then command the system to initialize. For example, the user might enter an "initialize" command or "filter reset" command via the user interface 115.

At step 305 system variables are initialized. At step 305 the system captures and stores in system memory the motor power at this time as the "baseline" or "nominal" motor power, represented by "$P_{nom}$" in FIGS. 3(*a*)-3(*c*). It will be apparent to one of ordinary skill in the art that other motor parameters may be substituted for motor power and stored as "$P_{nom}$", e.g. motor current or system current.

In an exemplary embodiment, the system computes and stores the "nominal" motor efficiency labelled "$E_{nom}$" according to the following formula:

$$E_{nom} = E_i = \frac{A_i}{P_i} \quad \text{Equation (1)}$$

$A_i$ represents the commanded airflow for motor 103, expressed in CFM, $P_i$ represents the present ($i^{th}$) motor power for motor 103, and $E_i$ represents the present motor efficiency. The system records "$P_{nom}$", and "$E_{nom}$" to system memory at step 305. These values represent the motor power and motor efficiency under nominal conditions (e.g. new filter and all registers open). The system also records the current time, represented by "$T_{start}$".

In an exemplary embodiment wherein the motor is a constant airflow motor, step 305 is repeated for a variety of commanded airflow values, and the resulting "$P_{nom}$" and "$E_{nom}$" are stored in system memory along with concomitant commanded airflow values. Thus, the system may store multiple "versions" of variables "$P_{nom}$" and "$E_{nom}$" associated with multiple commanded airflows. For example, at initialization (e.g., step 305) the system may command the motor to run at 3 airflow levels, e.g., 600 CFM, 1200 CFM, and 1800 CFM. For each airflow level, a concomitant "$P_{nom}$" and "$E_{nom}$" is stored.

Figure 4:
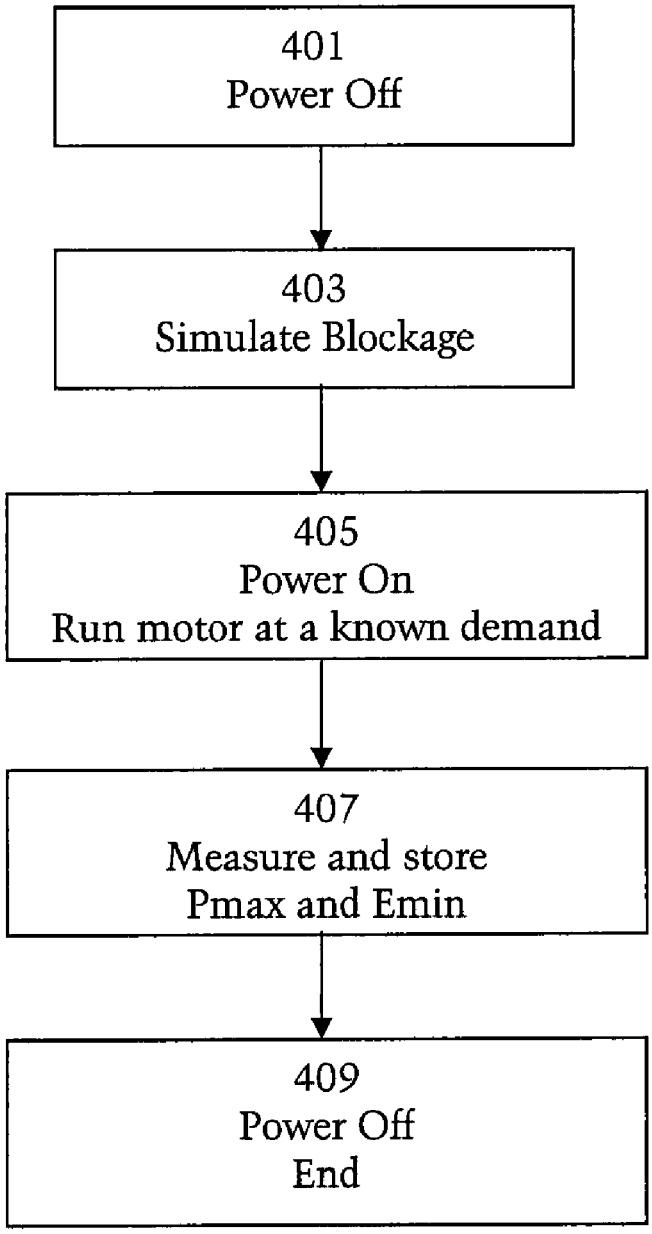
FIG. 4 illustrates an exemplary process for initializing a fluid delivery system.

Initialization (e.g., step 305) may include measuring a maximum motor power "$P_{max}$" and a minimum motor efficiency "$E_{min}$" that are associated with a clogged filter and/or frozen coil. An exemplary method for calculating "$P_{max}$" and "$E_{min}$" is shown in FIG. 4, and described in detail below.

Still with reference to FIG. 3(*a*), step 307 depicts a motor power measurement taken during standard (i.e. post-initialization) operation of the fluid delivery system and recorded as "$P_i$". The system computes and stores the motor efficiency labelled "$E_i$" according to the following formula:

$$E_i = \frac{A_i}{P_i} \quad \text{Equation (2)}$$

At step 307 the system computes and stores the value "$R_i$" which may represent change (or rate of change) in any motor parameter. Thus, in an exemplary embodiment the system computes and stores the rate of change in motor power represented by "$R_i$" according to the following formula:

$$R_i = \frac{P_i - P_{(i-1)}}{\Delta t} \quad \text{Equation (3A)}$$

Alternatively, (or additionally), the system computes and stores the rate of change in motor efficiency "$R_i$" according to the following formula:

$$R_i = \frac{E_i - E_{(i-1)}}{\Delta t} \quad \text{Equation (3B)}$$

$P_i$ represents the current motor power for motor 103, $P_{i-1}$ represents the motor power measurement from the previous iteration, and $\Delta t$ represents the difference in time between the current ($i^{th}$) iteration and previous ($(i-1)^{th}$) iteration. The present invention is not limited to using the immediately previous measurement, and could make use of other measurements, e.g. "$P_{(i-2)}$", "$P_{(i-3)}$", etc.

As would be understood by one of ordinary skill in the art, other motor parameters may be substituted for motor power in the above-noted calculations. For example, system current may be substituted for motor power and the $P_i$ measurement may represent the present ($i^{th}$) system current for motor 103. Other possible substitutions of other motor parameters will also be apparent with respect to the calculations below, but may not be specifically called out.

Next, at step 309, the system checks for a register condition by evaluating the following formula:

$$\|R_i\| \geqq R_{reg} \quad \text{Equation (4)}$$

Equation 4 tests whether the absolute value of "$R_i$" is greater than or equal to a threshold value "$R_{reg}$" associated with a register opening or closing. "$R_{reg}$" is a variable that may be the same for all systems, or may be specific to a particular system. If Equation 4 evaluates as "true" then system flow proceeds to step 311; otherwise flow proceeds to step 319.

At step 311, the system has detected a register open/close event. Register tracking may be used to account for the effects of register closings when performing other calculations. For example, the values of "$P_{nom}$" and "$E_{nom}$" may be adjusted based on the number of registers that have been closed since initialization. In the embodiment of FIG. 3(*a*), the system adjusts the value of "$P_{nom}$" according to the following formula:

$$P_{nom} = P_{nom} + (P_i - P_{i-1}) \quad \text{Equation (5A)}$$

By adjusting "$P_{nom}$" to account for register changes, the system is able to prevent register conditions from causing erroneous filter life readings, e.g. later at step 337. Equation (5) may be modified to adjust "$E_{nom}$" as follows:

$$E_{nom} = E_{nom} + (E_i - E_{i-1}) \quad \text{Equation (5B)}$$

System flow proceeds to step 313 to determine whether a register has been opened or closed.

At step 313 the system evaluates the following formula:

$$R_i \geqq R_{reg} \quad \text{Equation (6)}$$

If Equation (6) evaluates as "true" then flow proceeds to step 315; otherwise, flow proceeds to step 317. At step 315, the system reports (e.g., to the user interface 115) that a register has been closed. The system may store this event to memory, for example by incrementing a variable that tracks the number of closed registers. At step 317, the system reports (e.g., to the user interface 115) that a register has been opened. The system may store this event to memory, for example by decrementing a variable that tracks the number of closed registers. Optionally, the system may report an alarm if it detects that too many registers have been closed, thereby causing excessive restriction on airflow in the system. For example, the system may report an alarm for display on user interface 115 if the variable "Closed_Reg" exceeds a predetermined threshold. From steps 315 and 317, flow proceeds to step 319.

With reference to FIG. 3(*b*), at step 319 the system checks for a frozen coil condition by evaluating the following formula:

$$R_i \geqq R_{Freeze} \qquad \text{Equation (7)}$$

Equation (7) tests whether "$R_i$" is greater than or equal to a threshold value "$R_{Freeze}$" associated with a frozen coil. "$R_{Freeze}$." is a variable that may be the same for all systems, or may be specific to a particular system. If Equation (7) evaluates as "true" then flow proceeds to step 321; otherwise, flow proceeds to step 323. The system may not immediately report a frozen coil condition until a suspected frozen coil persists for a predetermined duration, e.g. about an hour. The system stores a variable ("Freeze_time" in this example) that keeps track of the duration of time that "$R_i$" has been above "$R_{Freeze}$", and thus indicating a suspected frozen coil.

At step 321, the variable "Freeze_time" is incremented and stored to memory, as a stored indication that step 321 has been reached, and flow proceeds to step 325.

At step 323, the variable "Freeze_time" is set to zero to indicate that a frozen coil is not suspected. If the system is in a de-icing mode when step 323 is reached, the system may return to normal operation. From step 323, flow proceeds to step 325.

At step 325, the system checks whether the current motor power "$P_i$" is above a threshold value "$P_{max}$" according to the following formula:

$$P_i \geqq P_{max} \qquad \text{Equation (8A)}$$

If Equation (8A) evaluates as "true" then flow proceeds to step 327, otherwise flow proceeds to step 331. "$P_{max}$" is a value that stores a power threshold associated with a total (about 100%) fluid flow restriction in the system. "$P_{max}$" is a variable that may be the same for all systems, or may be specific to a particular system. Optionally at step 325 the system may check whether motor efficiency "$E_i$" is below a threshold value "$E_{min}$" (e.g. instead of Equation (8A)) according to the following formula:

$$E_i \leqq E_{min} \qquad \text{Equation (8B)}$$

"$E_{min}$" is a value that stores an efficiency threshold associated with a total (about 100%) fluid flow restriction in the system. "$E_{min}$," is a variable that may be the same for all systems, or may be specific to a particular system. In an exemplary embodiment, other motor parameters may be substituted for efficiency. For example, "$P_{max}$" and "$P_i$" could be system current values. Optionally, "$P_{max}$" and/or "$E_{min}$" may be measured at the time of system installation or initialization (e.g. at step 305). FIG. 4 depicts an exemplary process for obtaining "$P_{max}$" and/or "$E_{min}$".

At step 327, the system checks to see whether the duration of suspected frozen coil indicated by "Freeze_time" is above a threshold value "FrzMax" according to the following formula:

$$\text{Freeze_time} \geqq FrzMax \qquad \text{Equation (9)}$$

Figure 5:
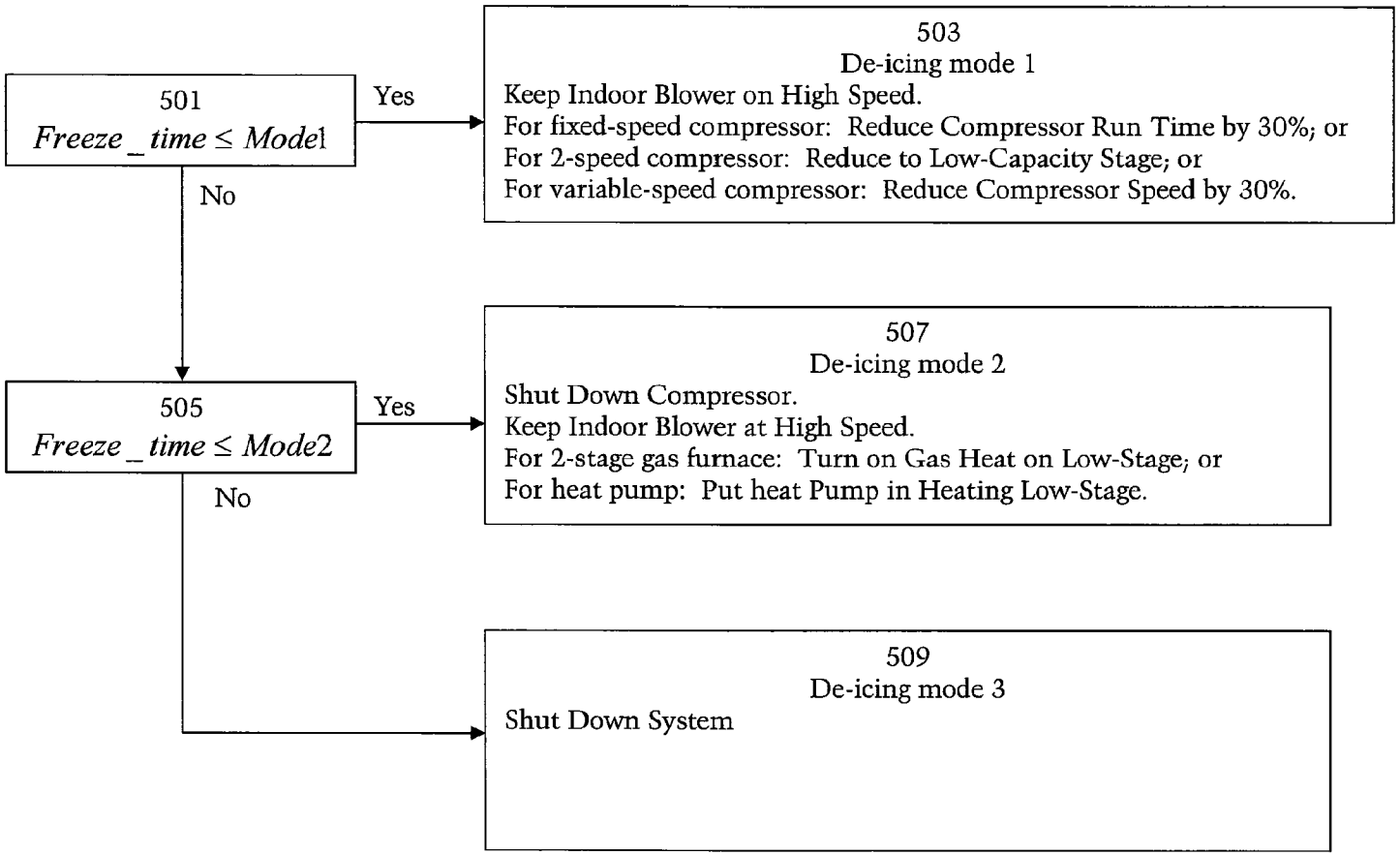
FIG. 5 illustrates an exemplary process for de-icing a frozen coil in a fluid delivery system.

"FrzMax" is a variable that may be the same for all systems, or may be specific to a particular system. In one exemplary embodiment, FrzMax is about 1 or 2 hours. If Equation (9) evaluates as "true" then flow proceeds to step 329; otherwise, flow proceeds to step 331. At step 329 the system reports (e.g. to the user interface 115) that a frozen coil has been detected. The system may also automatically initiate action to defrost the coil. For example, the system may cease cooling and enter a "defrost" or "de-icing" mode designed to thaw the coil. For example, the defrost mode may comprise blowing air across the coil without running the air conditioner compressor. Optionally, the system may enter a heating mode (e.g. by turning on the furnace or setting the heat pump to heat mode) to blow warm air across the coil. An exemplary flow diagram for de-icing modes is illustrated in FIG. 5. From step 329 flow proceeds to step 301.

At step 331, the system checks to see whether the amount of time since initialization (step 305) has been longer than the recommended filter lifetime according to the following formula:

$$(t - T_{start}) \geqq \text{Filter_time} \qquad \text{Equation (10)}$$

"t" represents the current time, "Tstart" is a time variable that was stored to memory when the filter was last replaced (e.g. at step 305), and "Filter_time" is a variable that stores the recommended filter lifetime. If Equation (10) evaluates as "true" then flow proceeds to step 333; otherwise, flow proceeds to step 335. At step 335, the system computes the filter life remaining ("Filter_life") based on the current motor power according to the following formula:

$$\text{Filter_life} = \frac{(P_{max} - P_i)}{(P_{max} - P_{nom})} \times 100\% \qquad \text{Equation (11)}$$

The result of Equation (11) may be used to compute an estimated time period that remains before a new filter is recommended, and the time period may be reported to a user (e.g. via user interface 115).

Next, at step 337, the system checks whether the remaining filter life calculated at step 335 is below a minimum threshold:

$$\text{Filter_life} \leqq \text{Filter_Life_Min} \qquad \text{Equation (12)}$$

"Filter_Life_Min" is a variable that may be the same for all systems, or may be specific to a particular system or a particular filter. If Equation (12) evaluates as "true" then flow proceeds to step 333; otherwise, flow proceeds to step 301. The system may not immediately report a clogged filter. For example, the system may not report a clogged filter until the "check filter" threshold condition has been met multiple times to avoid false reporting due to a transitory disturbance or the like.

At step 333, the system reports (e.g. to the user interface 115) that a clogged filter has been detected. Optionally, the system may enter a "limp-along mode" in response to a clogged filter detection. Such a "limp-along mode" could be designed to allow continued operation of the system until the filter is replaced. An exemplary limp-along mode for use when the system is in a heating mode comprises: repeatedly reduce blower speed; and, for a fixed-stage heater, reduce heat run time by 30%; or, for 2-stage heater, reduce to low-capacity or low modulation; or, for a heat pump heater, put heat pump in low-stage heating. An exemplary limp-along mode for use when the system is in cooling mode comprises: repeatedly reduce blower speed; and, for fixed-speed compressor, reduce compressor run time by 30%; or, for a 2-speed compressor, reduce to low-capacity stage; or, for a variable-speed compressor, reduce compressor speed by 30%. Other limp-along modes may be utilized without departing from the scope of the present invention.

System characterization may be performed on-site (e.g. by a user or installer after the system is installed in a building) or off-site (e.g. by the manufacturer prior to installation). System characterization may be performed by the original equipment manufacturer before the system is sent to a customer. System characterization may be performed by a homeowner or system installer, e.g. as part of step 305 shown in FIG. 3(*a*). System characterization may comprise motor characterization for a constant airflow motor. System characterization may comprise determining motor parameter values for later use in detection of system conditions. For example, system characterization may comprise determining motor parameter values under maximum blockage, e.g. "$P_{max}$" and/or "$E_{min}$".

Motor characterization for a constant airflow motor may comprise placing the system (e.g. air handler or furnace) in a calibrated airflow chamber, running the motor at different commanded airflow, varying loading (static) levels and recording torque and/or speed levels for each variation. As an example, the static pressure in the airflow chamber may be varied between 0 and 1 inch, and the commanded airflow may be varied from a "low" level (e.g. 400 CFM) to a "max" level (e.g. 1200). A mathematical fit may be performed on the data collected using system laws and/or empirical observations. An exemplary method of fitting the data to get the constant airflow coefficients is described in U.S. Patent Publication No. 2007/0248467 entitled "Fluid Flow Control for Fluid Handling Systems", the entire disclosure of which is incorporated by reference herein. Motor characterization for a constant airflow motor is also described in U.S. Pat. No. 5,447,414, entitled "Constant air flow control apparatus and method", the entire disclosure of which is incorporated by reference herein.

In a typical embodiment, detection of system conditions is based on measurement of the same motor parameter at different times, but this need not be the case. It will be apparent to those of ordinary skill in the art that calculations, such as the exemplary calculations of steps 307 and 335, may be based on two different motor parameters. For example, it may be the case that motor power and system power are linearly related such that system power is a simple multiple of motor power. So, for example, the system may compare system power to motor power after multiplication by a scalar value. In an exemplary embodiment, the system is configured to measure system power at a first time, measure motor power at a second time, and detect a system condition based on the difference.

FIG. 4 depicts an exemplary process for system characterization of a fluid delivery system.

At step 401 the system (e.g. air handler or furnace) is placed in a calibrated airflow chamber with system power shut off.

At step 403, a blockage (e.g. a clogged filter) is simulated. This may be achieved by replacing the filter with a "blocked filter simulator hardware" or by blocking off the ducts (e.g. blocking the outlet side of the heating unit), as examples. A system including a motor may be connected to an air flow chamber including simulated ductwork and registers, an airflow sensor, a filter of known resistance, and an external airflow controller to simulate actual conditions expected in the final (i.e. installed) system.

At step 405 the system power is turned on and the motor is commanded to run at a known demand (e.g. cooling mode CFM or a test mode torque or a test mode speed).

At step 407 the system measures the current motor power ("$P_i$"), and calculates the current motor efficiency ("$E_i$") according to Equation (2), and stores both variables to system memory, e.g. as variables "$P_{max}$" and "$E_{min}$," (respectively).

At step 409 the system power is shut off. If the system is on-site, any blockage is removed and the system may be returned to operating status.

This process (e.g. steps 405 and 407) may be repeated for a variety of commanded airflow levels, and multiple "versions" of "$P_{max}$" and "$E_{min}$" may be stored in system memory. For example, the system may command the motor to run at 3 airflow levels, e.g. 600 CFM, 1200 CFM, and 1800 CFM. For each airflow level, a concomitant "$P_{max}$" and "$E_{min}$" is stored.

In an exemplary embodiment, other motor parameters may be substituted for motor power or motor efficiency. For example, "$P_{max}$" could be a system current value.

As noted above, the system may store multiple "versions" of variables "$P_{nom}$", "$E_{nom}$", "$E_{min}$," and "$P_{max}$" associated with multiple commanded airflows. Later, e.g. at steps 325 and 335 of FIG. 3, the appropriate versions of "$P_{nom}$", "$E_{nom}$", "$E_{min}$." and "$P_{max}$" may be used depending on the current airflow demand.

FIG. 5 illustrates an exemplary process for de-icing a frozen coil in a fluid delivery system. Step 501 is reached after the system detects a frozen coil, e.g. at step 329 as shown in FIG. 3(*b*). At step 501 the system checks whether the duration of the frozen coil ("Freeze_time") is below a threshold for mode 1:

$$\text{Freeze_time} \leqq \text{Mode1} \qquad \text{Equation (13)}$$

If Equation (13) evaluates as "true" flow proceeds to step 503. Otherwise, flow proceeds to step 505. "Mode1" is a variable that may be the same for all systems, or may be specific to a particular system. As an example, Mode1 could be 15 minutes.

At step 503 the system enters exemplary de-icing mode 1, which comprises:

Keep Indoor Blower on High Speed.

If the system comprises a fixed-speed compressor: Reduce Compressor Run Time by 30%;

If the system comprises a 2-speed compressor: Reduce to Low-Capacity Stage;

If the system comprises a variable-speed compressor: Reduce Compressor Speed by 30%.

At step 505 the system checks whether the duration of the frozen coil ("Freeze_time") is below a threshold for mode 2:

$$\text{Freeze_time} \leqq \text{Mode2} \qquad \text{Equation (14)}$$

If Equation (14) evaluates as "true" flow proceeds to step 507. Otherwise, flow proceeds to step 509. "Mode2" is a variable that may be the same for all systems, or may be specific to a particular system. As an example, Mode2 could be 15 minutes.

At step 507 the system enters exemplary de-icing mode 2, which comprises:

Shut Down Compressor.

Keep Indoor Blower at High Speed.

If the system comprises a 2-stage gas furnace: Turn on Gas Heat on Low-Stage;

If the system comprises a heat pump: Put heat Pump in Heating Low-Stage.

At step 509 the system terminates the cooling or heating operation and shuts down the system to prevent damage to the system.

Various modifications of the above-described exemplary embodiments will be apparent to those of ordinary skill in the art. The full scope of the present invention is to be defined solely by the appended claims and their legal equivalents.

What is claimed is:

1. An apparatus for detecting a condition in a fluid delivery system, said apparatus comprising:

a motor control configured to provide electric power to an electric motor;

a logic circuit in communication with the motor control; and a memory in communication with the logic circuit, wherein the memory is configured to store a first rate threshold associated with a first system condition and a second rate threshold associated with a second system condition, wherein the second rate threshold is less than the first rate threshold;

wherein the logic circuit is configured to (1) determine a motor parameter at a first time within a time period and store, in the memory, a value indicative of the motor parameter at the first time associated with a value indicative of the first time and at a second time in the time period, (2) compute a change in the motor parameter within the time period as the difference between the motor parameter at the first time and the motor parameter at the second time, (3) compute an elapsed time as the difference between the second time and the first time, (4) compute a rate of change in the motor parameter within the time period as the computed change divided by the computed elapsed time, (5) store the computed rate of change in the memory, (6) compare the computed rate of change to the first rate threshold and if the computed rate of change is greater than the first rate threshold, determine that the first system condition has been detected, and (7) compare the computed rate of change to the second rate threshold and if the computed rate of change is greater than the second rate threshold but less than the first rate threshold, determine that the second system condition has been detected;

wherein the motor parameter is selected from the group consisting of system current, system power, system efficiency, motor current, motor power, and motor efficiency; and wherein the first system condition corresponds to a register condition, and the second system condition corresponds to a frozen coil condition.

2. An apparatus for detecting a condition in a fluid delivery system, said apparatus comprising:

a motor control configured to provide electric power to an electric motor;

a logic circuit in communication with the motor control; and a memory in communication with the logic circuit, wherein the memory is configured to store a first rate threshold associated with a first system condition, a second rate threshold associated with a second system condition, wherein the second rate threshold is less than the first rate threshold, and a third rate threshold associated with a third system condition, wherein the third rate threshold is less than the second rate threshold; and wherein the logic circuit is configured to (1) determine a motor parameter at a first time within a time period and store, in the memory, a value indicative of the motor parameter at the first time associated with a value indicative of the first time and at a second time in the time period, (2) compute a change in the motor parameter within the time period as the difference between the motor parameter at the first time and the motor parameter at the second time, (3) compute an elapsed time as the difference between the second time and the first time, (4) compute a rate of change in the motor parameter within the time period as the computed change divided by the computed elapsed time, (5) store the computed rate of change in the memory, (6) compare the computed rate of change to the first rate threshold and if the computed rate of change is greater than the first rate threshold, determine that the first system condition has been detected, (7) compare the computed rate of change to the second rate threshold and if the computed rate of change is greater than the second rate threshold but less than the first rate threshold, determine that the second system condition has been detected, and (8) compare the computed rate of change to the third rate threshold and if the computed rate of change is greater than the third rate threshold but less than the second rate threshold, determine that the third system condition has been detected; and wherein the motor parameter is selected from the group consisting of system current, system power, system efficiency, motor current, motor power, and motor efficiency.

3. The apparatus of claim 2 wherein the first system condition corresponds to a register condition, the second system condition corresponds to a frozen coil condition, and the third system condition corresponds to a filter condition.

4. An apparatus for detecting a condition in a fluid delivery system, said apparatus comprising:

a motor control configured to provide electric power to an electric motor;

a logic circuit in communication with the motor control; and a memory in communication with the logic circuit, wherein the memory is configured to store a first rate threshold associated with a first system condition and a first scalar threshold in the memory associated with a second system condition; and wherein the logic circuit is configured to (1) determine a motor parameter at a first time within a time period and store, in the memory, a value indicative of the motor parameter at the first time associated with a value indicative of the first time, (2) determine the motor parameter at a second time in the time period, (3) compute a change in the motor parameter within the time period as the difference between the motor parameter at the first time and the motor parameter at the second time, (3) compute an elapsed time as the difference between the second time and the first time, (4) compute a rate of change in the motor parameter within the time period as the computed change divided by the computed elapsed time, (5) store the computed rate of change in the memory, (6) compare the computed rate of change to the first rate threshold and if the computed rate of change is greater than the first rate threshold, determine that the first system condition has been detected, store, in the memory, an indication that the first system condition was detected, and modify the first scalar threshold value in memory in response to a determination that the first system condition has been detected; and wherein the motor parameter is selected from the group consisting of system current, system power, system efficiency, motor current, motor power, and motor efficiency.

5. The apparatus of claim 4 wherein the logic circuit is further configured to:

determine the motor parameter at a third time that is later than the first time and the second time;

compare the determined motor parameter to the first scalar threshold in the memory; and if the determined motor parameter is greater than the first scalar threshold value, determine that the second system condition has been detected.

6. The apparatus of claim 5 wherein the first system condition corresponds to a register condition and the second system condition corresponds to a filter condition.

7. An apparatus for detecting a condition in a fluid delivery system, said apparatus comprising:

a motor control configured to provide electric power to an electric motor;

a logic circuit in communication with the motor control; and a memory in communication with the logic circuit, wherein the memory is configured to store a first rate threshold associated with a first system condition, a second rate threshold associated with a second system condition, wherein the second rate threshold is less than the first rate threshold, and a first scalar threshold in the memory associated with a third system condition; and wherein the logic circuit is configured to (1) determine a motor parameter at a first time within a time period and store, in the memory, a value indicative of the motor parameter at the first time associated with a value indicative of the first time, (2) determine the motor parameter at a second time in the time period, (3) compute a change in the motor parameter within the time period as the difference between the motor parameter at the first time and the motor parameter at the second time, (4) compute an elapsed time as the difference between the second time and the first time, (5) compute a rate of change in the motor parameter within the time period as the computed change divided by the computed elapsed time, (6) store the computed rate of change in the memory, (7) compare the computed rate of change to the first rate threshold and if the computed rate of change is greater than the first rate threshold, determine that the first system condition has been detected, store, in the memory, an indication that the first system condition was detected and modify the first scalar threshold value in memory in response to a determination that the first system condition has been detected, and (8) compare the computed rate of change to the second rate threshold and if the computed rate of change is greater than the second rate threshold but less than the first rate threshold, determine that the second system condition has been detected;

wherein the motor parameter is selected from the group consisting of system current, system power, system efficiency, motor current, motor power, and motor efficiency.

8. The apparatus of claim 7 wherein the logic circuit is further configured to:

determine the motor parameter at a third time that is later than the first time and the second time;

compare the determined motor parameter to the first scalar threshold in the memory; and if the determined motor parameter is greater than the first scalar threshold value, determine that the third system condition has been detected.

9. The apparatus of claim 8 wherein the first system condition corresponds to a register condition, the second system condition corresponds to a frozen coil condition, and the third system condition corresponds to a filter condition.

10. The apparatus of claim 9 wherein the stored first scalar threshold corresponds to a nominal motor parameter value, and wherein the logic circuit is further configured to determine a filter life parameter based on the determined motor parameter and the nominal motor parameter value in the memory.

11. The apparatus of claim 9 wherein the logic circuit is configured to:

in response to a determination that the first system condition has been detected:

if the change in the motor parameter indicates that the motor is working harder to maintain a constant airflow, determine that a register close event has been detected and store, in the memory, an indication that a register has been closed; and if the change in the motor parameter indicates that the motor is working less hard to maintain a constant airflow, determine that a register open event has been detected and store, in the memory, an indication that a register has been opened.

12. The apparatus of claim 7 wherein the logic circuit is further configured to:

determine the motor parameter at a third time that is later than the first time and the second time;

compare the determined motor parameter to the stored first scalar threshold;

if the determined motor parameter is greater than the first scalar threshold value:

compute the rate of change in the motor parameter between the third time and the second time;

if the computed rate of change is greater than the first rate threshold, determine that the first system condition has been detected;

if the computed rate of change is greater than the second rate threshold but less than the first rate threshold, determine that the second system condition has been detected;

if the computed rate of change is less than the second rate threshold, determine that the third system condition has been detected.

13. The apparatus of claim 12 wherein the first system condition corresponds to a register condition, the second system condition corresponds to a frozen coil condition, and the third system condition corresponds to a filter condition.

14. An apparatus for detecting a condition in a fluid delivery system, said apparatus comprising:

a motor control configured to provide electric power to an electric motor;

a logic circuit in communication with the motor control; and a memory in communication with the logic circuit, wherein the memory is configured to store a first rate threshold associated with a register condition, a second rate threshold associated with a frozen coil condition, and a nominal motor parameter;

wherein the logic circuit is configured to (1) determine a motor parameter at a plurality of times within a time period, (2) compute a change in the motor parameter within the time period, (3) compute a rate of change in the motor parameter within the time period, (4) compare the computed rate of change to the first rate threshold stored in the memory, (5) if the computed rate of change is greater than the first rate threshold, determine that a register condition has been detected, and modify the nominal motor parameter value in the memory, (6) compare the computed rate of change to the second rate threshold stored in the memory, (7) if the computed rate of change is greater than the second rate threshold but less than the first rate threshold, determine that a frozen coil condition has been detected, and (8) compute a filter life parameter based on the motor parameter at the plurality of times and the nominal motor parameter value in the memory; and wherein the motor parameter is selected from the group consisting of system current, system power, system efficiency, motor current, motor power, and motor efficiency.

* * * * *

UNITED STATES PATENT AND TRADEMARK OFFICE

CERTIFICATE OF CORRECTION

PATENT NO. : 8,346,507 B2
APPLICATION NO. : 13/079320
DATED : January 1, 2013
INVENTOR(S) : Prakash B. Shahi et al.

It is certified that error appears in the above-identified patent and that said Letters Patent is hereby corrected as shown below:

In claim 4, column 14, line 46, please delete "(3)" and replace with --(4)--;
In claim 4, column 14, line 48, please delete "(4)" and replace with --(5)--;
In claim 4, column 14, line 50, please delete "(5)" and replace with --(6)--; and
In claim 4, column 14, line 51, please delete "(6)" and replace with --(7)--.

Signed and Sealed this
Ninth Day of April, 2013

Teresa Stanek Rea
*Acting Director of the United States Patent and Trademark Office*